US007721362B2

(12) United States Patent
Martin et al.

(10) Patent No.: US 7,721,362 B2
(45) Date of Patent: May 25, 2010

(54) SINK WITH REMOVABLE DIVIDER

(76) Inventors: Kenneth W. Martin, 2301 S. 12th St., Allentown, PA (US) 18103; Jill Martin, 2301 S. 12th St., Allentown, PA (US) 18103

( * ) Notice: Subject to any disclaimer, the term of this patent is extended or adjusted under 35 U.S.C. 154(b) by 997 days.

(21) Appl. No.: 11/434,335

(22) Filed: May 15, 2006

(65) Prior Publication Data

US 2007/0261164 A1 Nov. 15, 2007

(51) Int. Cl.
*E03C 1/186* (2006.01)

(52) U.S. Cl. ..... 4/514; 220/529; 220/532

(58) Field of Classification Search ..... 4/505, 4/514, 654; 220/529, 532
See application file for complete search history.

(56) References Cited

U.S. PATENT DOCUMENTS 211,856 A * 2/1879 Koch ..... 4/514
417,351 A * 12/1889 Anderson ..... 4/514
2,765,476 A 10/1956 Moore
4,333,188 A 6/1982 Jensen et al.
5,423,095 A 6/1995 Bearer
6,370,710 B1 4/2002 Haury et al.

* cited by examiner

*Primary Examiner*—Robert M Fetsuga
(74) *Attorney, Agent, or Firm*—Dale J. Ream

(57) ABSTRACT

A sink according to the present invention includes a sink basin having a bottom surface and a top surface with at least one side wall extending therebetween. The sink includes a divider that may be inserted into or removed from an interior area of the sink for selectively dividing the basin into multiple smaller compartments. An electromagnet is positioned beneath the bottom surface of the sink and is attracted to a ferrous material on the bottom of the divider for holding the divider securely when actuated. Channels defined by the sink side wall and other sealing components establish a watertight seal between compartments when the electromagnet is actuated. The electromagnet may be connected to the residential power source and may be activated by a user or, automatically, by a sensor. When the divider is removed, the larger single basin may be used for washing larger items.

20 Claims, 6 Drawing Sheets

SINK WITH REMOVABLE DIVIDER

BACKGROUND OF THE INVENTION

This invention relates generally to plumbing fixtures and, more particularly, to a sink with a removable divider for selectively utilizing the entire basin or dividing the basin into two portions.

Most residential sinks have two adjacent basins and are particularly useful for washing and rinsing dishes in sequence. Many commercial sinks, on the other hand, present a single larger basin for washing larger items. In the residential context, however, it is often desirable to wash pets, infants, grills, or other large items. A bathtub is sometimes used for this purpose as it presents a much larger basin even though it would be desirable to accomplish this task in the kitchen where countertops could be used. Various sink designs have been proposed in the art. Although assumably effective for their intended purposes, these sink designs do not provide for a selectively and conveniently removable divider or do not provide a mechanism for sealing and unsealing the divider.

Therefore, it would be desirable to have a sink with a removable divider for selectively separating a large single basin into multiple compartments. Further, it would be desirable to have a sink with a removable divider having an electromagnet that seals the divider when actuated and unseals the divider when not actuated. In addition, it would be desirable to have a sink with a removable divider that is safe and easy to use.

SUMMARY OF THE INVENTION

Accordingly, a sink according to the present invention includes a relatively large basin having at least one side wall connecting a bottom surface with a top surface. The sink may be mounted in a counter, such as in a residential kitchen, and may be used conveniently for bathing infants or pets or for washing items too large for a traditional sink basin, such as large cooking pans and utensils, cooking grill grates, and the like. The sink further includes a divider that may be vertically positioned within the interior area of the sink basin for selectively dividing the interior area into multiple compartments. In this way, the sink may be used in a traditional way, such as to wash dishes in one compartment and rinsing them in the other compartment.

The sink includes an electromagnet positioned beneath the bottom surface of the sink and the divider includes a complementary ferrous material. Accordingly, the ferrous material of the divider is magnetically attracted to the electromagnet when the electromagnet is actuated. This enables the divider to be held tight against the bottom surface of the sink to prevent leakage of water between the now-separate compartments. Channels defined by the side wall of the sink guide the divider into position and ensure flush alignment with the bottom surface of the sink. Gaskets may also be positioned about the divider for a watertight fit when the electromagnet is activated. A sensor may also be included for activating the electromagnet automatically upon detection of a predetermined condition such as the pressure of the divider against the bottom of the sink.

Therefore a general object of this invention is to provide a sink having a divider for selectively dividing a large basin into multiple compartments.

Another object of this invention is to provide a sink, as aforesaid, in which the divider may be efficiently inserted into or removed from the sink basin.

Still another object of this invention is to provide a sink, as aforesaid, having an electromagnet which magnetically holds the divider in place when actuated.

Yet another object of this invention is to provide a sink, as aforesaid, that is easy and convenient to use.

A further object of this invention is to provide a sink, as aforesaid, that may be mounted into a residential kitchen countertop.

Other objects and advantages of the present invention will become apparent from the following description taken in connection with the accompanying drawings, wherein is set forth by way of illustration and example, an embodiment of this invention.

DESCRIPTION OF THE PREFERRED EMBODIMENT

Figure 1:
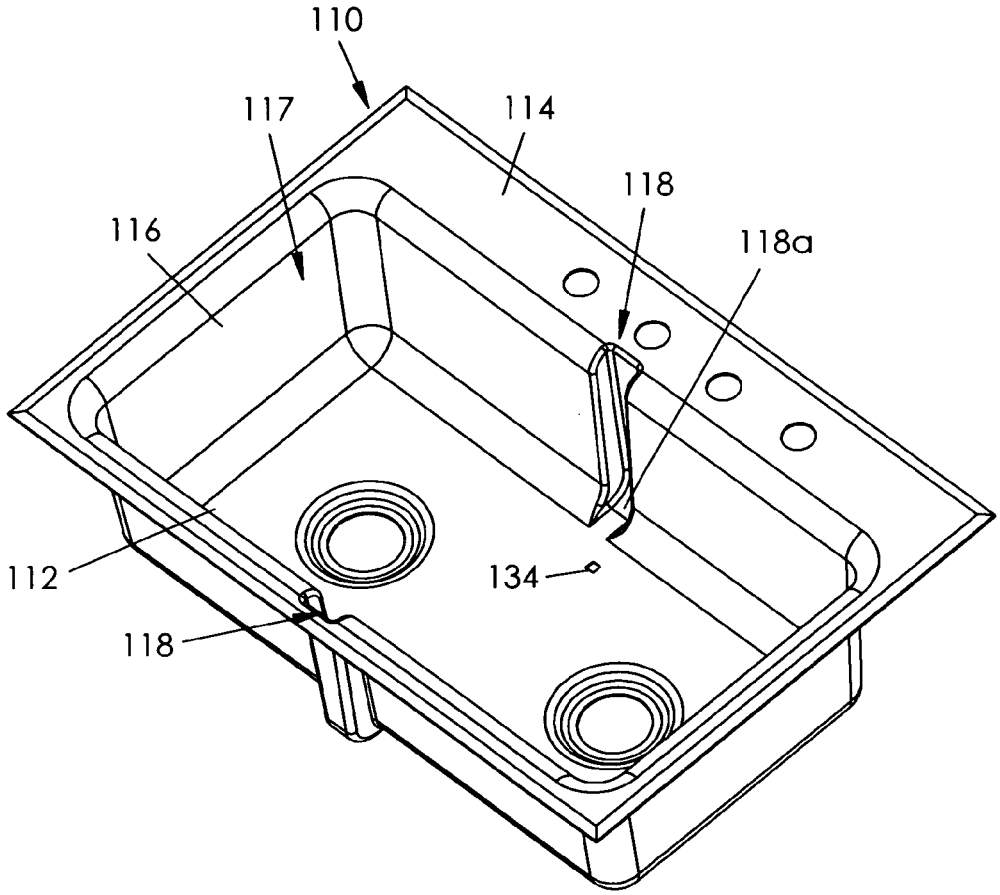
FIG. 1 is a perspective view of a sink according to the present invention with the divider removed.
Figure 2:
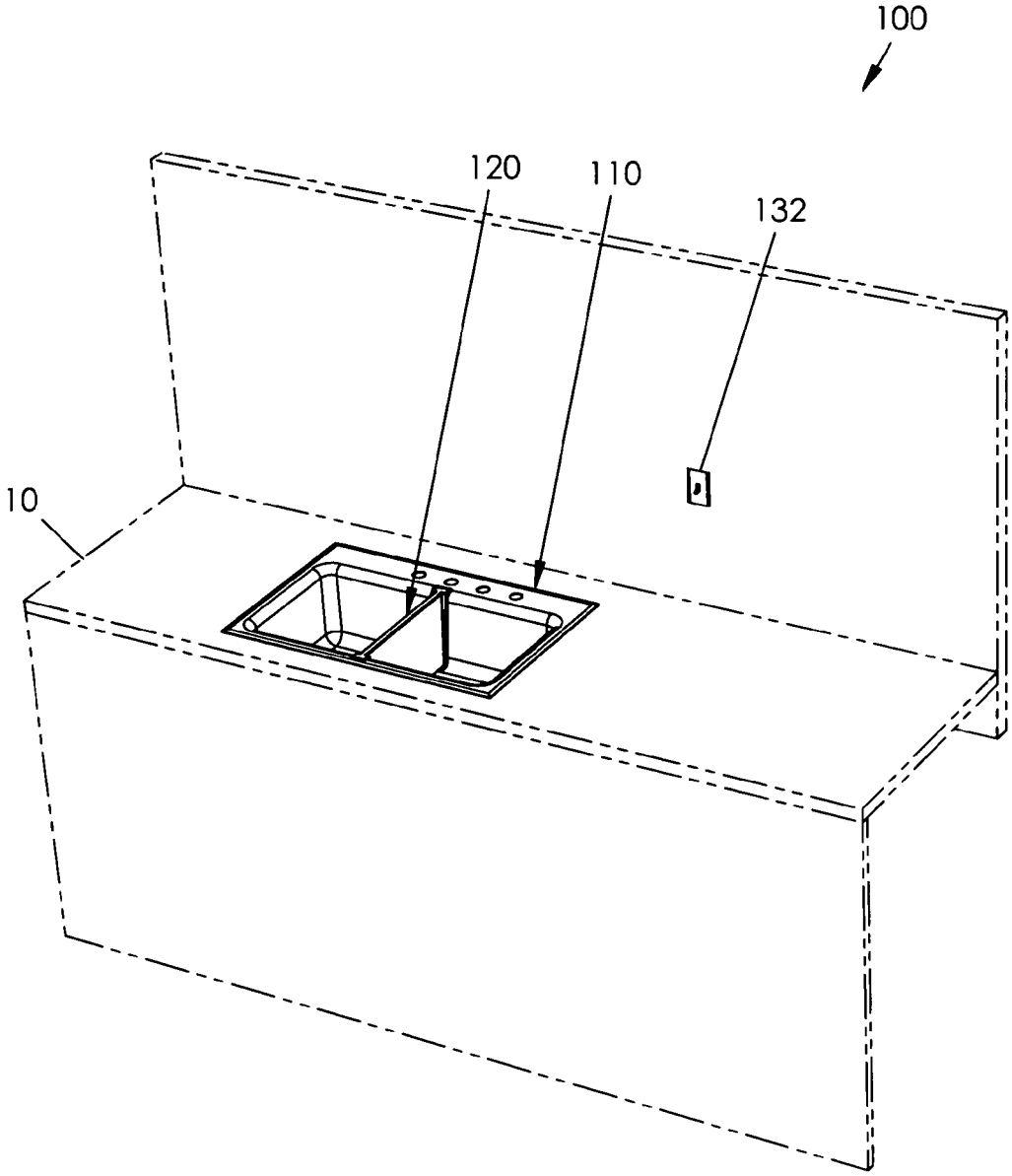
FIG. 2 is a perspective view of the sink as in FIG. 1 with the divider inserted and with the entire sink mounted into a countertop.

A sink 100 according to the present invention will now be described in detail with reference to FIGS. 1 through 7 of the accompanying drawings. More particularly, a sink 100 according to the current invention includes a basin 110, a divider 120, and an electromagnet 130.

The basin 110 presents a bottom surface 112 spaced apart from a top surface 114. At least one sidewall 116 connects the bottom and top surfaces 112, 114 to define an interior area 117 between the bottom surface 112, the top surface 114, and the at least one sidewall 116. If only one sidewall 116 is used, the basin 110 may be oval or round, for example; if more than one sidewall 116 is used, the basin 110 may be rectangular, octagonal, or other various shapes. The sidewall(s) 116 may define opposed channels 118, as shown throughout the drawings, and the channels 118 may have rounded lower corners 118*a*.

Figure 4:
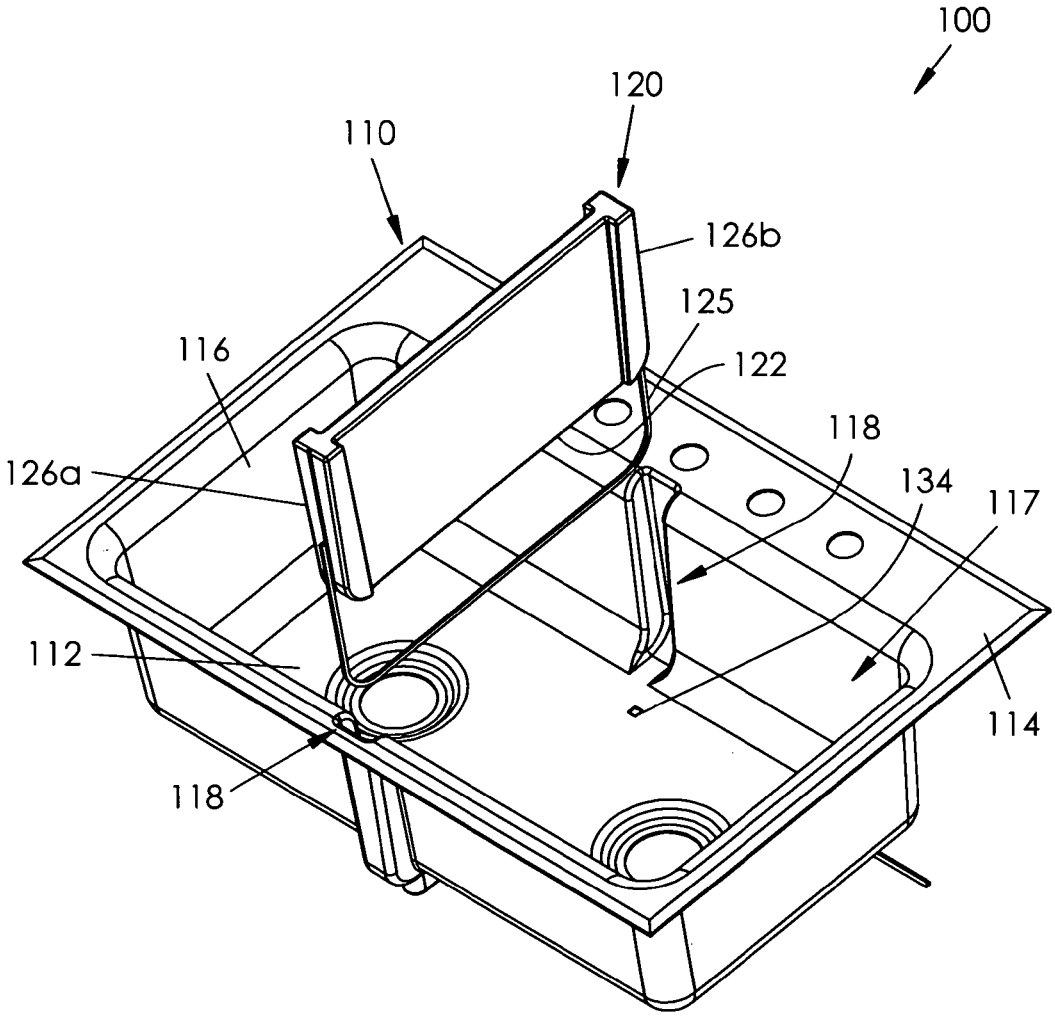
FIG. 4 is an exploded view of the sink as in FIG. 3.
Figure 5:
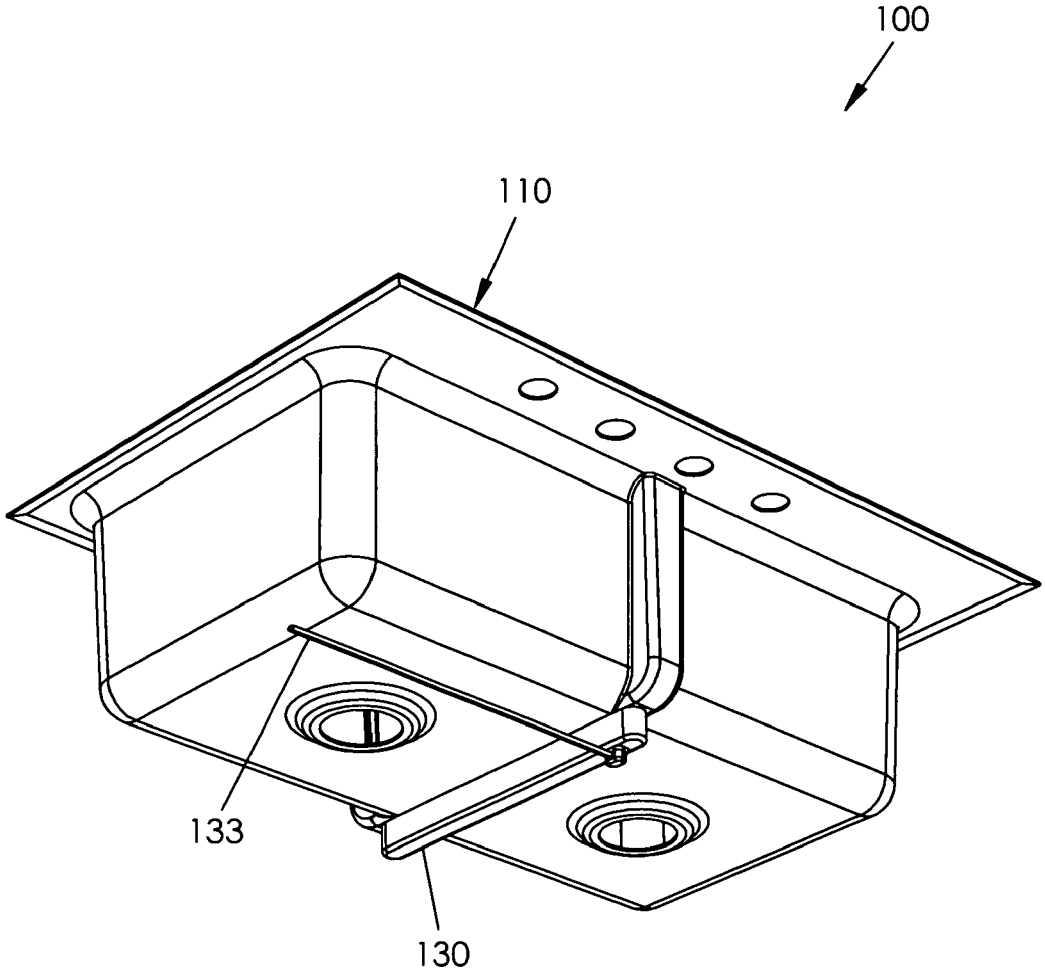
FIG. 5 is a bottom perspective view of the sink as in FIG. 1.
Figure 6:
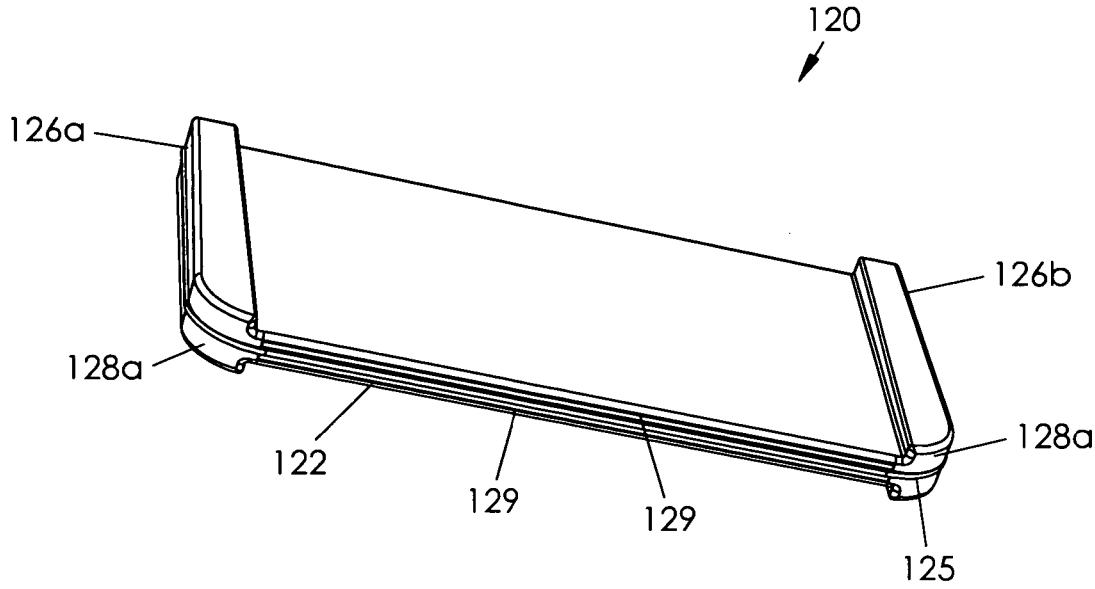
FIG. 6 is a bottom perspective view of the divider as in FIG. 3 removed from the sink.
Figure 7:
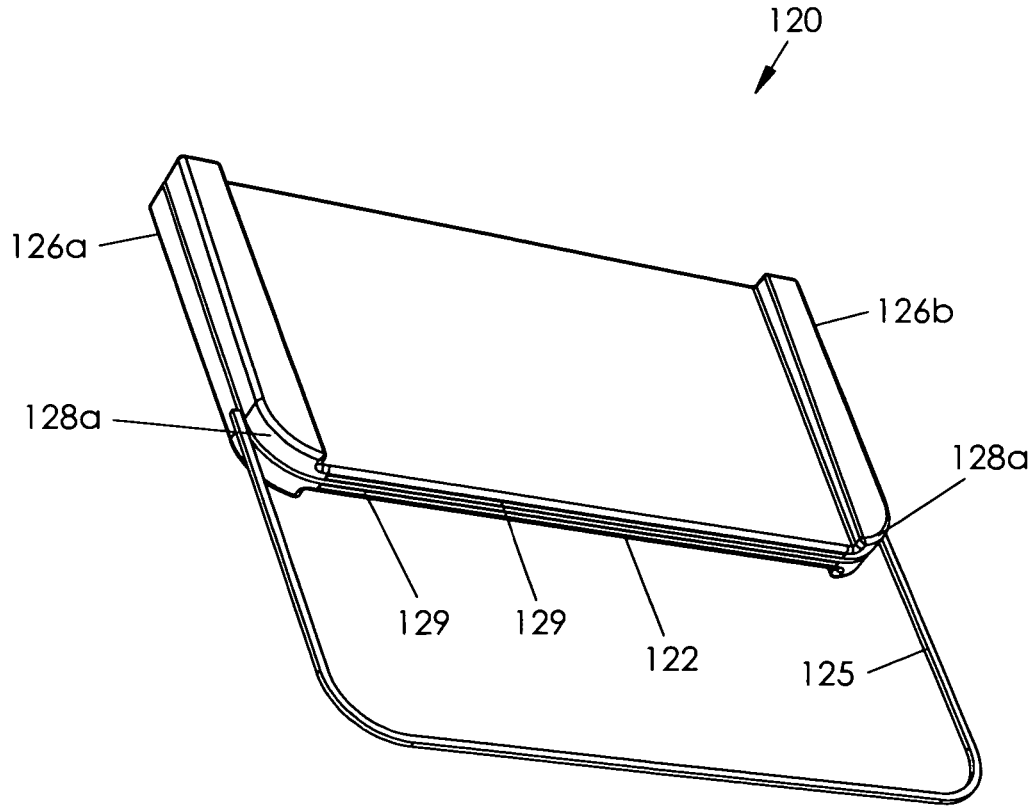
FIG. 7 is a perspective view of the divider as in FIG. 4 illustrating a gasket and other sealing components.

The divider 120 is sized to be received in the basin interior area 117 to partition the basin interior area 117. The divider 120 presents a bottom surface 122 generally complementary to the basin bottom surface 112. As shown throughout the drawings, the divider 120 may be received generally vertically in the basin interior area 117. The divider 120 has first and second sides 126*a*, 126*b* generally complementary to the basin sidewall(s) 116 when the divider 120 is received in the basin interior area 117. As shown in FIG. 4, the divider 120 may be sized to extend into the opposed channels 118 when received in the basin interior area 117, and as shown in FIGS. 6 and 7, the first and second sides 126*a*, 126*b* of the divider 120 may meet the divider bottom surface 122 to form rounded corners 128*a* complementary to the rounded lower corners 118*a* in the channels 118. A ferrous material 129 may be adjacent the divider bottom surface 122 for selective attraction to the electromagnet 130 as described below.

FIGS. 4, 6, and 7 show that a gasket 125 may be attached to the divider 120 for sealing the divider 120 to the basin 110 when the divider 120 is received in the basin interior area 117. The gasket 125 may extend along the entire divider bottom surface 122 and/or along a portion or all of the divider's first and second sides 126*a*, 126*b*.

The electromagnet 130 (FIG. 5) may be lowerly adjacent (below) the basin bottom surface 112, and the electromagnet 130 may be electrically connected to a power source, such as an AC or DC electrical current, with a traditional power cord 133. Means for actuating the electromagnet 130 are included. More particularly, a switch 132 (FIG. 2) may be electrically connected to the power source and the electromagnet 130 to selectively actuate the electromagnet 130. A sensor 134 may alternately or additionally be electrically connected to the power source and the electromagnet 130 to selectively actuate the electromagnet 130. The sensor 134 may be adjacent the basin bottom surface 112 as shown in FIG. 1, and the sensor 134 may be, for example, a pressure sensor, a water level sensor, or a moisture sensor.

Figure 3:
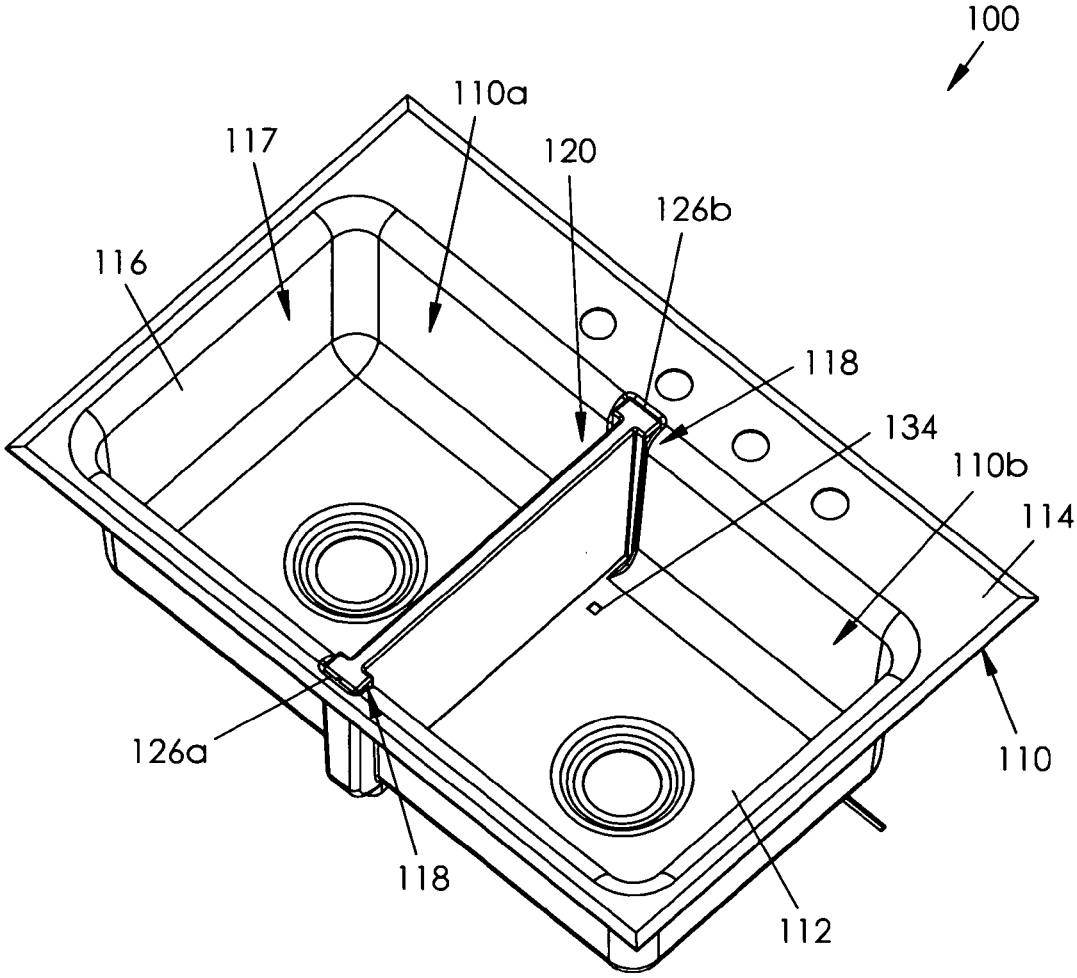
FIG. 3 is a perspective view of the sink as in FIG. 2 removed from the countertop.

In use, the basin 110 may be installed in a counter 10 (FIG. 2), and plumbing fixtures may be added, as is known in the art. When the user wants to use the entire basin 110, the divider 120 may be separated from the basin 110 as shown in FIG. 1. When the user wants to divide the basin 110 into multiple compartments 110*a*, 110*b* (e.g., to save water, to use the compartments for different purposes, etc.), the divider 120 may be inserted in the basin interior area 117 so that the divider bottom surface 122 is adjacent the basin bottom surface 112 and so that the divider's first and second sides 126*a*, 126*b* are adjacent the basin sidewalls 116 (FIG. 3). More particularly, the divider's first and second sides 126*a*, 126*b* may be in the channels 118, and the rounded corners 128*a* of the divider 120 may be adjacent the rounded lower corners 118*a* in the channels 118. The electromagnet 130 may then be actuated (e.g., by the switch 132 or the sensor 134), and the ferrous material 129 may be drawn to the electromagnet 130 to pull the divider 120 to the basin 110. The switch 132 may actuate the electromagnet 130 manually, or the sensor 134 may actuate the electromagnet 130 upon a predetermined event (such as water being present in the basin). The gasket 125 may seal the divider 120 to the basin 110 when the electromagnet 130 is actuated, separating the compartments 110*a*, 110*b*.

It is understood that while certain forms of this invention have been illustrated and described, it is not limited thereto except insofar as such limitations are included in the following claims and allowable functional equivalents thereof.

What is claimed is as follows:

1. A sink, comprising:

a basin presenting a bottom surface spaced apart from a top surface and at least one sidewall connecting said bottom and top surfaces for defining an interior area between said bottom surface, said top surface, and said at least one sidewall;

an electromagnet lowerly adjacent said basin bottom surface; and a divider sized to be received generally vertically in said basin interior area to partition said basin interior area, said divider presenting a bottom surface generally complementary to said basin bottom surface and having a ferrous material adjacent said bottom surface for selective attraction to said electromagnet.

2. The sink of claim 1, wherein:

said at least one sidewall defines opposed channels; and said divider includes a configuration for selectively extending into said opposed channels when received generally vertically in said basin interior area.

3. The sink of claim 1, further comprising a gasket attached to said divider for sealing said divider to said basin when said divider is received generally vertically in said basin interior area.

4. The sink of claim 3, wherein said gasket extends along the entire said divider bottom surface.

5. The sink of claim 1, wherein said electromagnet is connected to a power source, said sink further comprising means for actuating said electromagnet.

6. The sink of claim 5, wherein said means for actuating said electromagnet includes a switch electrically connected to the power source and said electromagnet.

7. The sink of claim 5, wherein:

said means for actuating said electromagnet includes a sensor adjacent said basin bottom surface; and said sensor is electrically connected to the power source and said electromagnet.

8. The sink of claim 7, wherein said sensor is selected from the group consisting of pressure sensors, water level sensors, and moisture sensors.

9. The sink of claim 1, wherein said divider has first and second sides generally complementary to said at least one sidewall of said basin when said divider is received generally vertically in said basin interior area.

10. The sink of claim 9, wherein:

said at least one sidewall defines opposed channels;

said divider is sized to extend into said opposed channels when received generally vertically in said basin interior area; and said divider first and second sides meet said divider bottom surface to form rounded corners complementary to rounded corners in said channels.

11. The sink of claim 10, further comprising a gasket attached to said divider for sealing said divider to said basin when said divider is received generally vertically in said basin interior area, said gasket extending along the entire said divider bottom surface and along at least a portion of said first and second divider sides.

12. The sink of claim 11, wherein:

said electromagnet is connected to a power source; and said sink further comprises means for actuating said electromagnet.

13. The sink of claim 12, wherein said means for actuating said electromagnet includes at least one device selected from the group consisting of:

A) a switch electrically connected to the power source and said electromagnet; and B) a sensor electrically connected to the power source and said electromagnet.

14. A sink, comprising:

a basin presenting a bottom surface spaced apart from a top surface and at least one sidewall connecting said bottom and top surfaces to define an interior area between said bottom surface, said top surface, and said at least one sidewall;

an electromagnet below said basin bottom surface, said electromagnet being electrically connected to a power source;

a divider sized to be received in said basin interior area to partition said basin interior area, said divider presenting a bottom surface generally complementary to said basin bottom surface and having a ferrous material adjacent said bottom surface for selective attraction to said electromagnet; and means for actuating said electromagnet.

15. The sink of claim 14, wherein said means for actuating said electromagnet includes at least one device selected from the group consisting of:

A) a switch electrically connected to the power source and said electromagnet; and B) a sensor electrically connected to the power source and said electromagnet.

16. The sink of claim 15, wherein said sensor is selected from the group consisting of pressure sensors, water level sensors, and moisture sensors.

17. The sink of claim 14, wherein said divider includes first and second sides that are generally complementary to said at least one sidewall of said basin when said divider is received in said basin interior area.

18. The sink of claim 17, wherein:

said at least one sidewall defines opposed channels having rounded lower corners;

said divider is sized to extend into said opposed channels when received in said basin interior area; and said divider first and second sides meet said divider bottom surface to form rounded corners complementary to said rounded lower corners in said channels.

19. The sink of claim 18, further comprising a gasket attached to said divider for sealing said divider to said basin when said divider is received in said basin interior area, said gasket extending along the entire said divider bottom surface and along at least a portion of said first and second divider sides.

20. The sink of claim 14, further comprising a gasket attached to said divider for sealing said divider to said basin when said divider is received in said basin interior area, said gasket extending along the entire said divider bottom surface.

* * * * *